US012630331B2

(12) United States Patent
Gari de León

(10) Patent No.: US 12,630,331 B2
(45) Date of Patent: May 19, 2026

(54) REMOVABLE METAL PALLET KIT

(71) Applicant: Francisco Armando Gari de León, Montevideo (UY)

(72) Inventor: Francisco Armando Gari de León, Montevideo (UY)

(73) Assignee: Francisco Armando Gari de León, Montevideo (UY)

( * ) Notice: Subject to any disclaimer, the term of this patent is extended or adjusted under 35 U.S.C. 154(b) by 137 days.

(21) Appl. No.: 18/390,434

(22) Filed: Dec. 20, 2023

(65) Prior Publication Data

US 2024/0208691 A1 Jun. 27, 2024

(30) Foreign Application Priority Data

Dec. 21, 2022 (UY) ..... 4863

(51) Int. Cl.
*B65D 19/12* (2006.01)
*B65D 19/00* (2006.01)

(52) U.S. Cl.
CPC ..... *B65D 19/12* (2013.01); *B65D 19/0024* (2013.01)

(58) Field of Classification Search
CPC ..... B65D 19/12; B65D 19/0024; B65D 19/08
USPC ..... 108/57.32, 153.1
See application file for complete search history.

(56) References Cited

U.S. PATENT DOCUMENTS 1,321,812 A * 11/1919 Drumm ..... B65D 71/0092 108/57.32
1,334,409 A * 3/1920 Sindelar ..... B65D 19/0028 108/57.29
1,612,382 A * 12/1926 Lehman ..... B65D 19/0028 108/57.29
2,692,107 A * 10/1954 De Ridder ..... B65D 19/0095 108/57.17
3,616,766 A * 11/1971 Weiss ..... B65D 19/0097 108/57.32
4,485,744 A * 12/1984 Umemura ..... B65D 19/0095 108/57.18
5,809,906 A 9/1998 Janek
8,403,284 B2 3/2013 Korbonski
9,751,657 B2 * 9/2017 Cote ..... B65D 19/0095
11,242,173 B2 * 2/2022 Rickabaugh ..... B65D 19/08
11,702,244 B2 * 7/2023 Rickabaugh ..... B65D 19/0026 108/57.32
2014/0345501 A1 * 11/2014 Lundius ..... B65D 19/40 108/51.11
2015/0059624 A1 * 3/2015 Kuo ..... B65D 19/0018 108/57.25

FOREIGN PATENT DOCUMENTS

KR 101665005 B1 10/2016

* cited by examiner

*Primary Examiner* — Daniel J Troy
*Assistant Examiner* — Timothy M Ayres
(74) *Attorney, Agent, or Firm* — Jeffrey N. Townes; Cozen O'Connor

(57) ABSTRACT

The demountable metal pallet kit is constructed from sections of a single type of profile or beam with an omega or truncated "V" appearance. These sections, arranged longitudinally and transversally, are joined together by their upper part or head using removable mounting elements.

Figure 1:
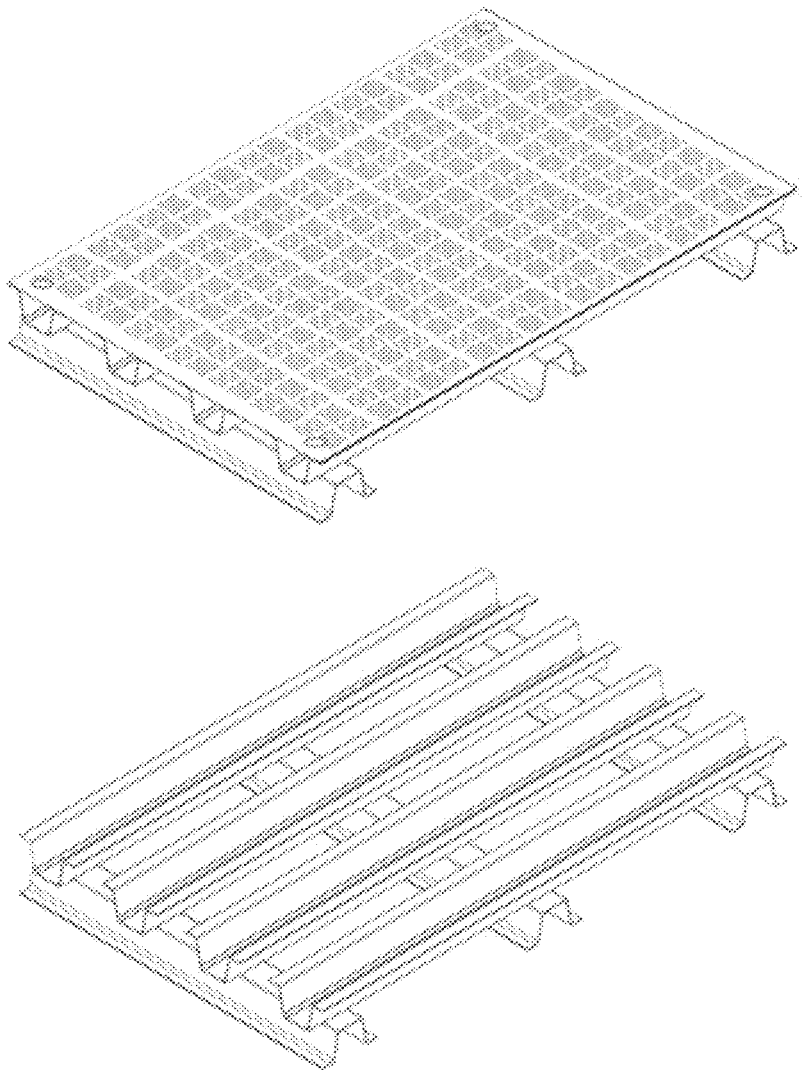

An upper metal plate is placed on the longitudinal profiles, which includes perforations for attaching load securing elements or adjusting polyamide protection sheets for the load, especially during transportation when they may experience strong oscillations.

2 Claims, 8 Drawing Sheets

FIG. 8

Alloys: Aluminum - Magnesium - Silicon 6005 A

Chemical composition

| % | Si | Fe | Cu | mn | Mg | Cr | Zn | Ti | Mn+Cr | Others |
|---|---|---|---|---|---|---|---|---|---|---|
| Minimum | 0.50 | | | | 0.40 | | | | 0.12 | |
| Maximum | 0.90 | 0.35 | 0.30 | 0.50 | 0.70 | 0.30 | 0.20 | 0.10 | 0.50 | 0.15 |

International equivalences

| Europe | USES | Spain | France | Germany | GB | Italy | Sweden | Swiss | Japan |
|---|---|---|---|---|---|---|---|---|---|
| EN 573 | AA | UNE | AFNOR | DIN | B.S. | UNI | SIS | VSM | JIS |
| IN AW 6005A | 6005th | 38,349 L-3454 | A-SG0.5 | AlMgSi0.7 3.3210 | | 9006/6-P6 | | AlMgSi0.7 | |

Mechanical properties

Standard: EN 755-2 Alloy: EN AW-6005 [Al SiMg]

extruded bar

| Treatment status | Measurements mm | | Rm MPa | | Rp0.2MPa _ | | A % A50 mm % | | Hardness H.B. |
|---|---|---|---|---|---|---|---|---|---|
| | D1) | S2) | min. | max. | min. | max. | min | min. | |
| T65) | 25 | 25 | 270 | -- | 225 | -- | 10 | 8 | 90 |
| | 25 < D 50 | 25 < S 50 | 270 | -- | 225 | -- | 8 | -- | 90 |
| | 50 < D 100 | 50 < S 100 | 260 | -- | 215 | -- | 8 | -- | 90 |

extruded tube

| Treatment status | Measurements mm e3) | Rm Mpa | | Rp0.2MPa _ | | TO % | A50mm % |
|---|---|---|---|---|---|---|---|
| | | min. | max. | min. | max. | min | min. |
| T65) | 5 | 270 | -- | 225 | -- | 8 | 6 |
| | 5 < e 10 | 260 | -- | 215 | -- | 8 | 6 |

Extruded profile10)

| Treatment status | Measurements mm e3) | Rm Mpa | | Rp0.2Mpa _ | | TO % | A50mm % |
|---|---|---|---|---|---|---|---|
| | | min. | max. | min. | max. | min | min. |
| *Open profile* T45) | 25 | 180 | -- | 90 | -- | [illegible] | 13 |
| T65) | 5 | 270 | -- | 225 | -- | 8 | 6 |
| | 5 < e 10 | 260 | -- | 215 | -- | 8 | 6 |
| | 10 < e 25 | 250 | -- | 200 | -- | 8 | 6 |
| *hollow profile* T45) | 10 | 180 | -- | 90 | -- | [illegible] | 13 |
| T65) | 5 | 255 | -- | 215 | -- | 8 | 6 |
| | 5 < e 15 | 250 | -- | 200 | -- | 8 | 6 |

1) D = Diameter of circular section bars.
2) S = Distance between faces for square and hexagonal section bars, thickness for rectangular section bars. 3) e = Wall thickness.
5) Characteristics can be obtained by press cooling.
10) In case the cross section is composed of elements of different thicknesses for which different values of specified mechanical characteristics apply, the lower of the specified values must be considered valid for the entire section.

FIG. 8 (continued)

ALUMINUM Alloys Aluminum - Magnesium - Silicon 6005 A

Physical properties

| Elastic modulus N/mm2 | Specific weight g/cm3 | Melting temperature °C | Linear expansion coefficient 1/108 K | Thermal conductivity W/mK | Electrical resistivity at 20°C- cm | Electric conductivity % IACS | Dissolution potential V |
|---|---|---|---|---|---|---|---|
| 69,500 | 2.71 | 600-650 | 23.5 | 192 | 3.4 | 49.5 | -0.83 |

Technological skills

| Welding | | Natural behavior | | Anodized | | Mechanization Status: T5 | | T6 |
|---|---|---|---|---|---|---|---|---|
| to the flame | MB | In a rural environment | MB | MB protection | | Chip fragmentation | R | R |
| To arc under argon gas | B | In industrial environment | | B Decorative | B | Surface gloss | MB | MB |
| By electrical resistance | MB | In marine environment | | B Hard anodized | MB | | | |
| Brasgado | MB | In sea water | | | | | | |

| Heat treatments | Products | Observations and applications |
|---|---|---|
| Forging temperature range: 350°-500°C Total annealing: 420°C, with slow cooling up to 250°C.<br><br>Annealing against pungency: 340°C | Bars, wire, extruded profiles, tubes. | This alloy is very easy to extrude. With the T5 condition a better surface finish and better straightness are achieved. Used for bus and railway car structures, electric poles, platforms, pipelines, shipbuilding industry, automobile industry, etc. |

REMOVABLE METAL PALLET KIT

FIELD OF THE INVENTION

The invention generally refers to industrial pallets for the storage or transportation of goods, and more particularly to a demountable pallet kit or system made of metal.

DESCRIPTION OF THE RELATED TECHNIQUE

A pallet is used in the storage and transportation of goods to enable lifting by a forklift or other type of lifting or handling device. Goods are typically secured to a pallet by means of a strap, tarpaulin or securing tool. In many cases pallets are designed to be reused multiple times.

Pallets are usually made of hardwoods or composite materials, which depending on the load may represent moderate to very costly disadvantages.

The most notable disadvantage arises from the fact that such materials can harbor insect species and plant diseases. As a result, these types of pallets are treated with pesticides, fungicides or other potentially harmful chemicals to improve their resistance to weather and pests. This makes conventional pallets inadequate and even dangerous for transporting goods from industries such as food or pharmaceuticals. Metal pallets that achieve the appropriate performance, by balancing load stability, durability and price, represent a competitive advantage for the manufacturer, carrier and owner of the goods.

Metal does not usually harbor pathogens or insects, or represent a fire hazard, and can be sanitized using chemicals or liquids, under pressure and at different temperatures. Metal pallets are strong, and the different alloys used in their manufacture allow them to achieve amazing resistance to friction, compression and torsion. Despite these advantages, metal pallets also have a number of inherent disadvantages, most notably a high initial price. Metal pallets are more expensive to manufacture than wooden ones, although in the long term, given their extended service life, the costs are equalized or even reversed.

Reference to the prior art can be made in patent US20210114768 and its international search history, where a pallet with metallic material handling is described, wherein corrugated profiles and a spaced parallel base with corrugated members, both fixed to tubular cross supports, supporting an essentially flat top plate are also observed.

Some of these disadvantages, particularly cost and weight, can be mitigated by design improvements that allow for more effective use of lighter gauge metal materials. However, switching to lighter gauge metal sheets generally results in reduced load capacity and/or a decrease in stacking strength. Frictional resistance at the bottom of the assembly (buckling and torsional forces) will introduce stresses to consider for the structural integrity of the stacked pallets and load. The higher initial cost of a metal pallet is often justified by the expectation of a long service life. Unfortunately, a longer service life means more opportunities for exposure to damage. Damage, mostly caused by forklift use, can result in unstable stacking conditions or operator negligence.

The search for new improved metal pallet systems for the transport of loads, which preserve the functionalities of the pallets in use, is a reality in the industry nowadays.

In short, we are looking for all the advantages of a particular metal pallet, but one that suffers less from the known deficiencies; namely, high initial cost, high weight, and service-related damage.

BRIEF SUMMARY OF THE INVENTION

The present invention comprises a demountable metal pallet kit or system built with sections of a single type of omega or truncated "V" aspect profile made of lightweight material: aluminum alloy, polymeric, or cellulosic, with dimensions and load capacity according to ISO norms that constitute the standard in the technique.

The sections of the profile that are arranged longitudinally and transversally, one on top of the other, will be joined together by their upper part or head, using: screws with blind nuts, optionally POP rivets, spot welding or adhesives.

A carved upper metal plate is placed on the longitudinal profiles, which includes perforations for the attachment of load securing elements or the adjustment of polyamide protection sheets for the load, when transport requires it. These allow the load to be secured to the assembled pallet kit, particularly in the case of transport by land, sea or air, which may be subject to strong oscillations.

BRIEF DESCRIPTION OF MULTIPLE DRAWINGS

FIG. 1. Perspective view of the assembled structure of a pallet kit and optionally without a top plate.

Figure 2:
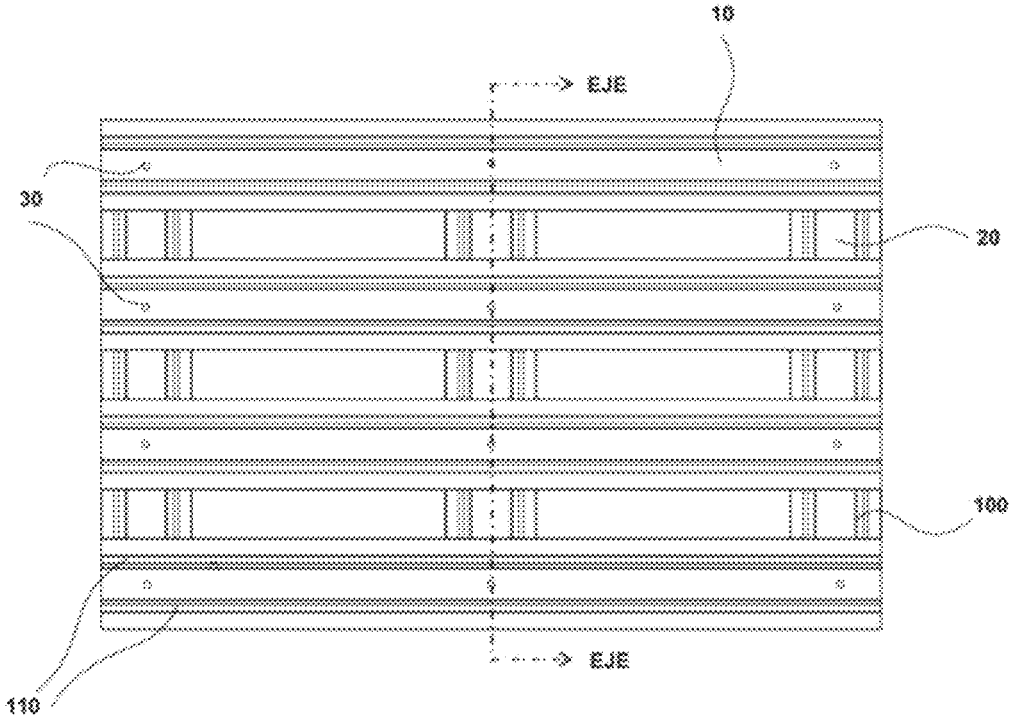

FIG. 2. Top view of the pallet kit showing longitudinal profiles or beams "10" assembled on the transverse profiles or beams "20".

Figure 3:
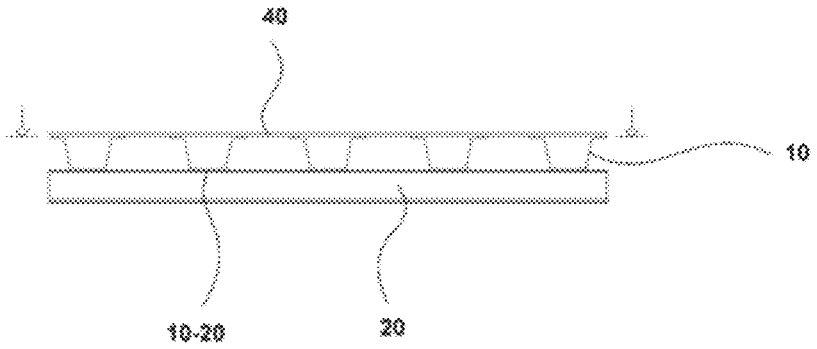

FIG. 3. Side view of the assembled pallet kit.

Figure 4:
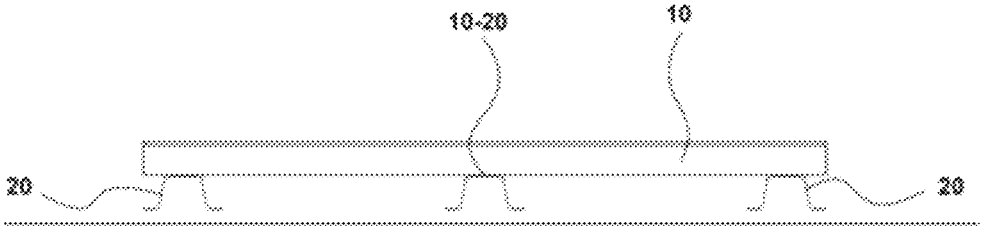

FIG. 4. Front view of the assembled pallet kit.

Figure 5:
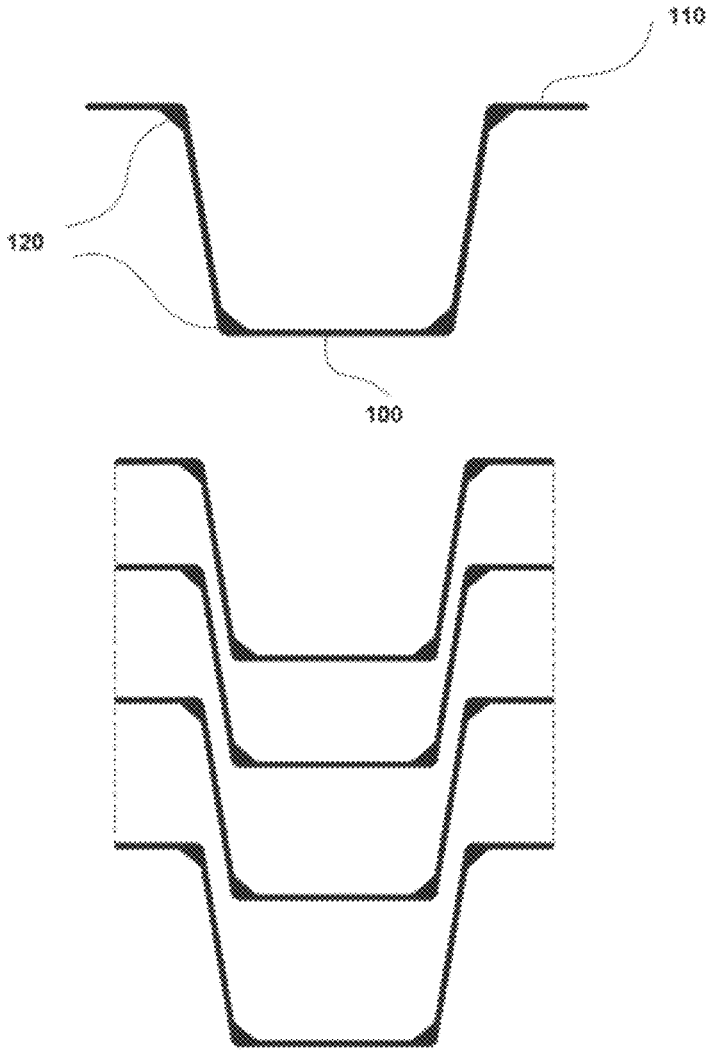

FIG. 5. Front view of the longitudinal "10" and transverse profiles or beams, showing their omega or truncated "V" appearance, their head "100", legs "110" and ribs "120". The stacking capacity of the profiles or beams that make up the metal pallet kit can be seen.

Figure 6:
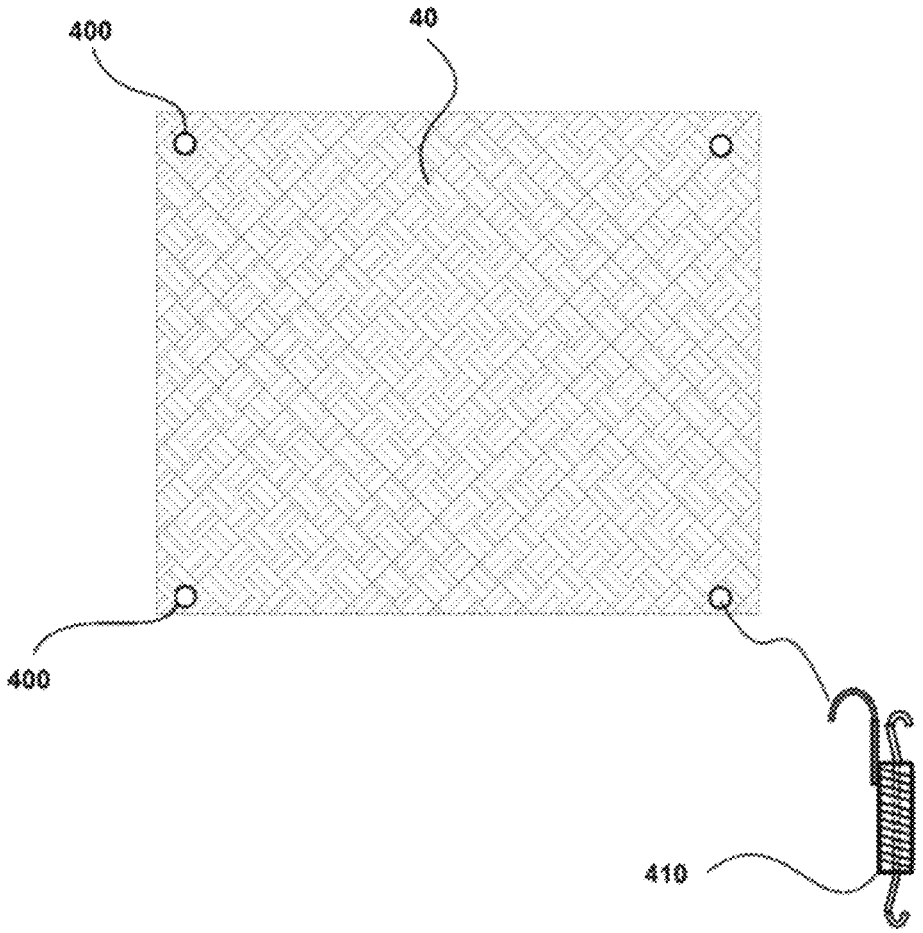

FIG. 6. View of the upper plate "40", where the reinforced perforations "400" for the attachment of the limited extension springs or tensors "410" can be observed.

Figure 7:
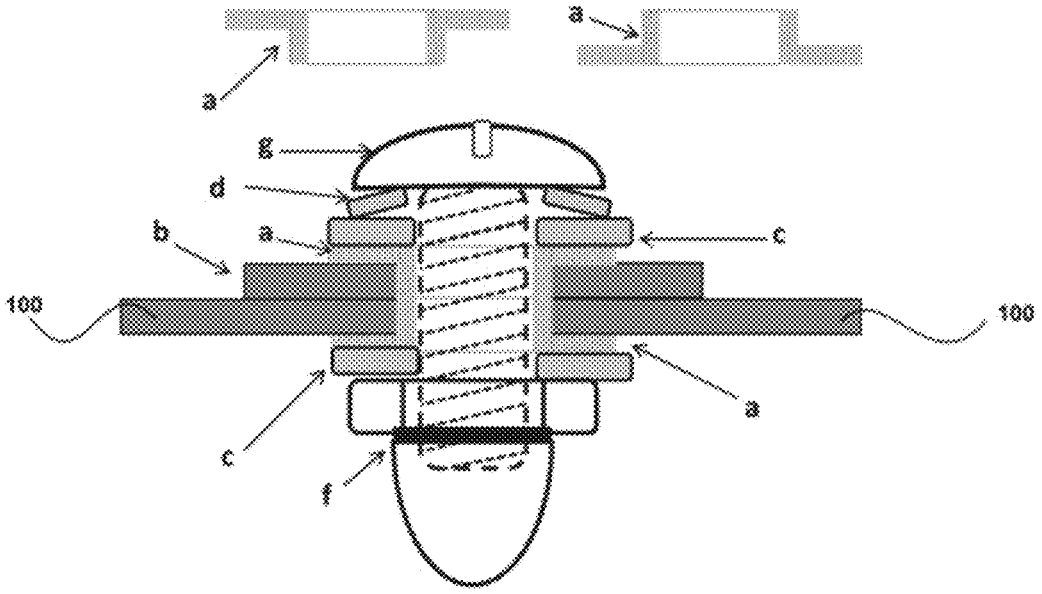

FIG. 7. View of the mounting elements "30" of the pallet kit, integrating polyamide coating to avoid galvanic corrosion.

FIG. 8. Description of metal alloys as a basis for calculation in implementation example 1.

DETAILED DESCRIPTION OF THE INVENTION

The main advantages of this kit or demountable pallet system respond to the shortcomings observed in the technique. They can be defined as a reduction in the total volume of the disassembled kit, more specifically in the order of one seventh of its assembled volume, low weight, simple and agile for its assembly and eventual repair, sterilizable with products compatible with the food and pharmaceutical industries without damaging the integrity of the pallet.

The proposed metal pallet kit allows to reduce freight costs from the factory, manufacturing times due to the low number of pieces, which has a positive impact on compensating the value of the materials—metals and/or alloys that compose it, in comparison with traditional materials.

In short, it meets the previously mentioned objective, namely, reduction of the initial cost of metal pallets, reduction of the weight maintaining load capacity, resistance to chemical and climatic agents or negligence of operators.

This demountable metal pallet kit or system has been especially designed to enable the transfer to the customer who is at a considerable distance from the factory that produces them, to withstand their sanitization using substances at different temperatures, accepted or compatible with the food and pharmaceutical industries, especially without losing qualities or deteriorating in the treatment of their surfaces.

Likewise, the simplification of its components allows it to equal and even exceed the resistance of the pallets known in the technique, when subjected to horizontal and vertical forces or the buckling itself produced by the elastic torsion forces generated by the movement of the load they support.

Repairs and maintenance are extremely fast and economical, as the number of parts that make up the kit or system is reduced to a minimum.

The described demountable pallet kit may adopt different dimensions or proportions, but in the most common and traditional configuration it has a generally rectangular shape sized to suit, but not limited to, a particular container loading application.

In its preferred implementation, it comprises five (5) longitudinal profiles or beams with an omega or truncated "V" appearance, three (3) shorter transverse profiles or beams, with an omega or truncated "V" appearance, and a metal plate to be placed as a loading base for the goods or packages.

It is not excluded that due to industry needs the number of longitudinal or transverse profiles or beams may be greater, in the need to opt for whole pallets twice the length.

The dimensions and load capacity of this kit of assembled pallets respectively comply with ISO 6780 2003 and ISO 8611 2 2021 standards.

Following these guidelines, the size of the demounted pallet kit allows placing around 2,800 units in a forty (40)-feet-long container, while, if the assembled pallet kit is transported, the loading capacity in the same container will be only 480 units.

The stacking capacity of the profiles or beams (FIG. 5), coupled with the reduced number of pieces that make up the proposed pallet kit, provides significant benefits for maintaining stock in dealerships or distributors. This is because it reduces storage costs for the same number of pallets, thereby further minimizing the initial cost of a metal-made pallet.

To facilitate the assembly of the pallet, local dealers or distributors at the recipient's location are supplied with by the factory. Using these tools, an operator equipped with a simple portable electric screw driver can assemble 15 pallets per hour. Additionally, when the pallet kit is assembled with fixed or permanent fastening elements, a pneumatic riveting machine can be used to apply POP rivets.

Referring to the figures, where identical numbers denote corresponding parts across various views, a fully metal demountable pallet kit is typically depicted, as shown in FIGS. 1 to 7.

The Kit includes longitudinal profiles or beams "10" and transverse profiles or beams "20". The assembled unit represents the superposition of these profiles or beams, with the former overlapping the latter. Both overlap in such a way that their closed surfaces or the head section "100" of the omega or truncated "V" shaped profile or beam come into contact in opposite directions, as shown in FIG. 2.

The longitudinal profiles or beams "10" are equipped with predetermined perforations or contact points for fixation, matching the number or quantity of transverse profiles or beams "20" onto which they will be attached. These are designated as fixing points "10-20".

In its preferred implementation, in accordance with the previously mentioned industry standards, five (5) longitudinal profiles or beams "10" are arranged on three (3) transverse profiles or beams "20". Three (3) fixing points "10-20" are established on the longitudinal profiles or "10" and five (5) fixing points "10-20" are established on the transverse profiles or "20", as depicted in FIGS. 2 to 5.

The assembly of the longitudinal "10" and transverse "20" profiles or beams is accomplished via the "10-20" fixing points. Preferably, this is done using "30" assembly elements, such as screws with blind nuts, POP type rivets, and optionally spot welding or adhesives for a permanent assembly of the kit or system.

The use of Belleville type washers is recommended for screwed joints. This guarantees the rigidity of the assembly when sterilized with steam or substances at temperatures of 130° C. or higher, due to the action of expansion factors of the assembly parts above said temperature.

The use of electrical insulating rings, made of polyamide or equivalent, in the contact of the mounting elements "30" at the fixing points "10-20", is highly beneficial. It helps to prevent galvanic corrosion between the aluminum and stainless steel of the screws, POP type rivets, as illustrated in FIG. 7.—

When it becomes necessary to dismantle the described pallet in seasonal production situations, or for reasons such as space availability in warehouses or storage costs, in pharmaceutical labs or food product factories, stainless steel bolts with nuts are recommended as mounting elements "30".

FIG. 7 describes the assembly system for the mounting elements "30". This includes screws "g", blind nuts "f", and austenitic stainless steel washers "c". Polyamide or similar insulating bushings "a" are used to prevent galvanic corrosion during sterilization with steam at 2.5 Bar. Additionally, Belleville DIN 6796 "d" martensitic stainless steel washers are used to maintain the rigid joint of the assembled pallet kit, during high temperature sterilization.

The assembled pallet kit features an upper section with a metal plate "40" fixed to longitudinal profiles or beams "10", designed to bear the weight of the goods. It also has a lower section, consisting of transverse profiles or beams "20". These profiles or beams make contact with the ground via their legs "110", providing stability. The frontal position of these profiles or allows easy access for the loading nails of the elevators, as depicted in FIG. 4.

As depicted in FIG. 6, the metal plate "40" is mounted onto the longitudinal profiles or beams "10". A rigid connection between the metal plate's surface and the legs "110" of the longitudinal profiles or beams "10" can be established using welding, mechanical interlocking or other suitable fixing methods. This ensures the "demountable kit" feature is fulfilled without compromising the integrity of its components.

In its ideal configuration, it consists of a kit with five (5) longitudinal profiles or beams "10". This setup results in ten (10) contact points or legs "110" extending across the full width of the metal plate "40". Adhesives compatible with the pharmaceutical and food industries are suggested for the fixation method.

The metal plate "40" is equipped with reinforced perforations "400" at its corners. These allow the load to be adjusted using ropes, flanges or polyamide canvas. As seen in FIG. 6, including springs or tensional devices "410" is recommended. These are beneficial for preventing load shifts and absorbing the torque forces generated by the load's movement during transport or storage. This design enables the load to be securely fastened, even at angles of up to 40°.

The historical use of this technique indicates that complex structures, forming tubes of various shapes, are primarily employed as profiles or beams. Their interlocking systems provide structural resistance, ensuring the system retains its overall strength even under pressure. However, damage to any component, can lead to a loss of the entire structure's integral strength rendering it unusable.

The pallet kit described here is distinguished by being based on a structure of metal profiles or beams typically produced by extrusion. This method allows for accurate calculations of resistance to deformation. The structure, configured as a single piece, offers increased resistance to impacts without compromising the strength of the assembled piece.

Furthermore, damage to one of the profiles or beams can be swiftly remedied with minimal material expense and work duration.

The longitudinal profiles or beams "10" and transverse profiles or beams "20" that make up the kit, appearing as omega or truncated "V" shapes, are produced in metal alloys, typically by extrusion. They need to meet construction requirements that enable them to withstand the pressure of the load and elastic movements without deforming.

The pallet kit's functionality largely depends on the ability of these metal profiles to resist deformation of their openings or concave mouths. Their legs "110" are attached to the metal plate "40" and maintain the assembled kit's contact with the ground. It is worth noting that the transverse profiles or "20" will be subjected to blows and pressure from the load lifting devices.

It is observed that the legs "110" and head "100" of the longitudinal profiles or beams "10" and transverse profiles or beams "20" incorporate ribs "120" within their folds. This design enhances the rigidity of their structure.

Example 1 shows the calculations carried out on the loads or forces to which the elements that make up the kit can be subjected, following the standards of the technique, where the longitudinal beams or profiles "10" and transverse beams or profiles "20" are made in accordance to the metal alloys indicated in FIG. 8.

Example 1

| | | |
|---|---|---|
| LOAD TEST STANDARD ISO 8611 2 2021 | 2840 | Kg. |
| PALLET LENGTH | 120 | cm. |
| PALLET WIDTH | 100 | cm. |
| WING WIDTH | 2.8 | cm. |
| NUMBER OF WINGS | 8 | |
| LOAD BEARING SURFACE | 2688 | cm2 |
| AVERAGE WING LOADING | 1.057 | Kg/cm2 |
| OVERHEAD LOAD SURFACE OF Ω | 36.0 | cm2 |
| NUMBER OF HEADS | 12 | |
| AVERAGE HEAD LOAD OF Ω | 6.6 | Kg/cm2 |
| LOAD SECTION ON SIDES OF EACH Ω | 2.4 | cm2 |
| COMPRESSION LOAD PER SIDE OF Ω | 118.3 | Kg |
| BUCKLING CALCULATION OF Ω SIDEWALLS | | |
| YIELD STRESS LIMIT ALLOY 6005A (MINIMUM) | 2250 | Kg/cm2 |
| SIDEWALL COMPRESSION SAFETY COEFFICIENT | 19 | |
| PROFILE THICKNESS | 0.25 | cm |
| CALCULATION OF THE MOMENT OF INERTIA OF THE PROFILE SIDEWALL | 0.000781 | cm4 |
| SIDEWALL HEIGHT | 7.4 | cm |
| CALCULATION OF THE CRITICAL LATERAL BUCKLING LOAD OF THE PROFILE Ω | 388.6 | Kg |
| COLUMN SECTION AREA | 1.5 | cm2 |
| BUCKLING SAFETY FACTOR | 3.3 | |

Implementation Example 1 illustrates that the kit or pallet is composed of rigid and lightweight materials, capable of supporting the load, usage, and sterilization without causing damage to the kit or system. The proposed profiles or beams, in terms of the quantity of material used, are cost-effective and advantageous due to the minimal number of components that make up the kit. This feature also leads to cost savings in the assembly and transportation process to and from customers. Notably, the disassembled kit occupies only one-seventh of the space required by the assembled kit-pallet.

The invention claimed is:

1. A disassemblable metal pallet kit, comprising:

at least four longitudinal braces or profiles (10), mounted perpendicularly on and fixed to at least three transverse braces or profiles (20), at predetermined fixing points (10-20) by mounting elements (30), all of which collectively constitute the rectangular skeletal framework that provides the foundational support of the cargo pallet; and an upper metallic sheet (40) fixed to longitudinal braces or profiles (10), at predetermined fixing points by mounting elements (30), thereby ensuring stable surface support and increased resistance to deformation under load;

wherein both longitudinal braces or profiles (10) and the transverse braces or profiles (20) are formed by the same omega-shaped or truncated V-shaped cross-section, and are further characterized by reinforcing ribs (120) integrated into the folds of their heads (100) and legs (110) to prevent buckling or bending of the profiles, thereby ensuring dimensional stability and enabling the structure to withstand higher load capacities.

2. The disassemblable metal pallet kit of claim 1, wherein the mounting elements (30) are stainless steel blind nuts and screws, POP rivets, or adhesives compatible with pharmaceutical and food industries.

* * * * *